US010086387B2

(12) United States Patent
Kah, Jr.

(10) Patent No.: US 10,086,387 B2
(45) Date of Patent: Oct. 2, 2018

(54) SELECTABLE ARC AND RANGE OF COVERAGE SPRAY NOZZLE ASSEMBLY WITH MULTIPLE FLUIDIC FAN SPRAY NOZZLES

(71) Applicant: Carl L. C. Kah, Jr., North Palm Beach, FL (US)

(72) Inventor: Carl L. C. Kah, Jr., North Palm Beach, FL (US)

( * ) Notice: Subject to any disclaimer, the term of this patent is extended or adjusted under 35 U.S.C. 154(b) by 262 days.

(21) Appl. No.: 13/784,156

(22) Filed: Mar. 4, 2013

(65) Prior Publication Data

US 2013/0228637 A1 Sep. 5, 2013

Related U.S. Application Data

(60) Provisional application No. 61/606,086, filed on Mar. 2, 2012.

(51) Int. Cl.
*B05B 1/08* (2006.01)
*B05B 1/16* (2006.01)

(52) U.S. Cl.
CPC ..... *B05B 1/1681* (2013.01); *B05B 1/08* (2013.01); *B05B 1/1627* (2013.01)

(58) Field of Classification Search
CPC ..... B05B 15/00; B05B 1/262; B05B 1/3086; B05B 1/267; B05B 1/08; B05B 1/1681; B05B 1/1627; B05B 15/70; B05B 1/304; B05B 15/74; B05B 1/14; B05B 1/3006; B05B 1/202; B05B 3/044; A01G 25/00; B60S 1/52; Y10T 137/2093; Y10T 137/2185; F15B 21/12; F15C 1/22
USPC ..... 239/71, 73, 456, 457, 560, 513, 579, 239/581.1, 581.2, 582.1, 589.1; 230/200–210
See application file for complete search history.

(56) References Cited

U.S. PATENT DOCUMENTS

| | | | | |
|---|---|---|---|---|
| 4,184,636 | A * | 1/1980 | Bauer | 239/11 |
| 5,360,167 | A * | 11/1994 | Grundy et al. | 239/460 |
| 7,032,836 | B2 * | 4/2006 | Sesser et al. | 239/204 |
| 2005/0167526 | A1 * | 8/2005 | McKenzie et al. | 239/225.1 |
| 2008/0257982 | A1 | 10/2008 | Kah et al. | |
| 2009/0188991 | A1 | 7/2009 | Russell et al. | |
| 2010/0078501 | A1 * | 4/2010 | Miller et al. | 239/236 |
| 2010/0090036 | A1 * | 4/2010 | Allen et al. | 239/589.1 |
| 2010/0108787 | A1 * | 5/2010 | Walker et al. | 239/589 |
| 2011/0089250 | A1 | 4/2011 | Zhao et al. | |

* cited by examiner

*Primary Examiner* — Steven J Ganey
*Assistant Examiner* — Juan C Barrera
(74) *Attorney, Agent, or Firm* — Amster, Rothstein & Ebenstein LLP

(57) ABSTRACT

Adjustable arc of coverage spray nozzle assembly for irrigation where the spray is characterized by the water jets which are cyclically deflected at a high frequency such that they break up into fan shaped water droplet patterns in which the fluid distribution and droplet size can be controlled. Jet deflection is accomplished with energy in the pressurized liquid itself. Multiple fluidic oscillating stream nozzle cavities are molded into a circular plate surround and adjustable arcuate length orifice valve so that one or a series of these fluidic discharge nozzles can be selected to have pressurized water to provide a selectable arc of coverage around a single sprinkler nozzle assembly.

20 Claims, 13 Drawing Sheets

SELECTABLE ARC AND RANGE OF COVERAGE SPRAY NOZZLE ASSEMBLY WITH MULTIPLE FLUIDIC FAN SPRAY NOZZLES

CROSS-REFERENCE TO RELATED APPLICATIONS

The present application claims benefit of and priority to U.S. Provisional patent Application Ser. No. 61/606,086 filed Mar. 2, 2012 entitled SELECTABLE ARC AND RANGE OF COVERAGE SPRAY NOZZLE ASSEMBLY WITH MULTIPLE FLUIDIC FAN SPRAY NOZZLES, the entire content of which is hereby incorporated by reference herein.

BACKGROUND

Field of the Disclosure

The present disclosure relates to irrigation sprinkler spray nozzles.

Related Art

Spray nozzle sprinklers of many types are well known in the irrigation industry. Fixed deflection of a water stream fan sprays are one type and manufactured by many irrigation equipment companies worldwide.

In recent years, a great deal of innovative effort has been emerging to provide very uniform precipitation rate coverage over larger areas by each sprinkler with a lower flow rate per sprinkler. Concentrating the flow into streams, or a multiplicity of smaller streams, is used to allow greater range of coverage from each sprinkler at lower flow rates and to achieve more uniform precipitation fall out of the water.

The use of fluid nozzles to generate the spray from an irrigation sprinkler can provide very uniform coverage at reduced water flow rates at extended ranges out from the sprinkler.

Examples of fluidic fan spray nozzle devices are described in U.S. Pat. Nos. 4,052,002; 4,508,267 and 4,463,904, for example.

The Toro Company offers fluidic spray nozzles, which require nine different arc of coverage spray nozzles for a selection of 60° to 360° of coverage around their spray nozzles with fluid nozzle cavities.

It would be desirable to provide a more flexible fluidic spray nozzle.

SUMMARY

In an embodiment, multiple fluidic oscillating stream nozzle cavities are molded into a circular nozzle plate surround an adjustable arcuate length discharge orifice so that it can be used to selectively provide high pressure water to the fluidic nozzle cavities inlet orifices to allow selecting an arc of irrigation coverage provided by the selected fluidic nozzle with their inherent large drop fall out pattern that carries further in air and may be designed to provide a very uniform fall out coverage pattern with lower water flow rates than conventional spray nozzles. The fluidic nozzle spray is characterized by water jets, which are cyclically deflected at high frequency such that they break up into fan shaped water droplet patterns in which the water distribution and droplet size can be controlled by the fluidic geometry. Jet deflection and oscillation is accomplished with no moving parts with the pressure energy in the water through the arc of coverage adjustable arcuate length of axially stepped arc selection valve which can be sequentially opened to include more of the orifice inlet to the fluidic nozzles surrounding the fluid spray nozzle center arc of coverage selection valve member. The selected arc of coverage may be indicated on the top of the spray nozzle assembly by the rotational position of the center valving member.

A spray nozzle assembly in accordance with an embodiment of the present disclosure includes a housing element including an inlet configured to receive water from a supply, the housing element including a central bore defining a flow path for the water, a plurality of nozzle chambers positioned circumferentially around the housing and configured to selectably distribute water from the spray nozzle assembly and a valve member extending into the central bore of the housing and configured to selectably control flow of water through the flow path and to the plurality of nozzle chambers, such that only selected nozzle chambers distribute water.

Other features and advantages of the present invention will become apparent from the following description of the invention that refers to the accompanying drawings.

DETAILED DESCRIPTION OF THE EMBODIMENTS

U.S. Patent Publication No. 2008/0257982 and U.S. Pat. No. 7,232,081 are excellent references for design of the adjustable arc of coverage arcuate valves as well as the upstream range control flow throttling valves. The entire content of each of these references is hereby incorporated by reference herein.

Figure 1:
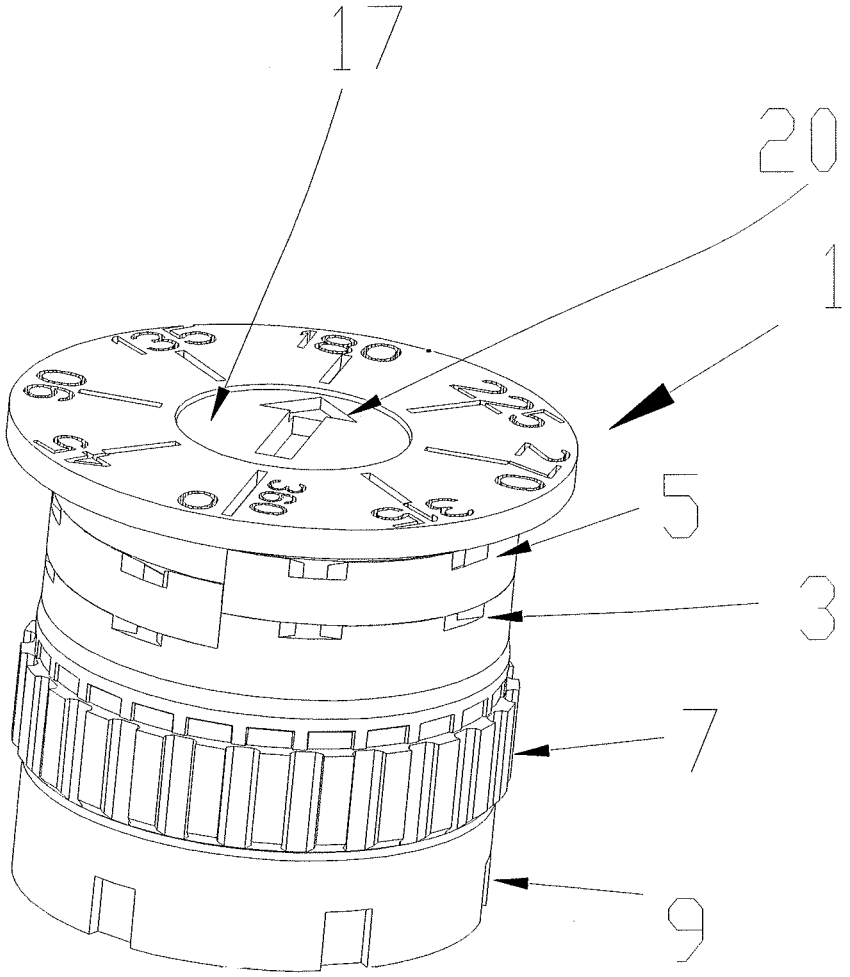
FIG. 1 shows a perspective view of a selectable arc and range of coverage spray nozzle assembly made up of selectable individual fluidic nozzles, which indicate selected arc of coverage.

FIG. 1 shows a perspective view of a selectable arc of coverage spray nozzle assembly 1 made up of individual fluidic nozzles as shown at 3 and 5, which are in two circumferential rows of nozzles. The lower row at 3 may be optimized for a low discharge elevation angle, i.e., 12° and short ranges underneath. The upper row at 5 which can be for a higher elevation discharge angle, i.e., 27° and optimizes for longer range of coverage. A circumferential manually rotatable ring 7 surrounds the lower portions of the nozzle assembly 1 to provide for upstream pressure throttling of the water which is provided to the fluidic nozzles as shown at 3 and 5.

Figure 2:
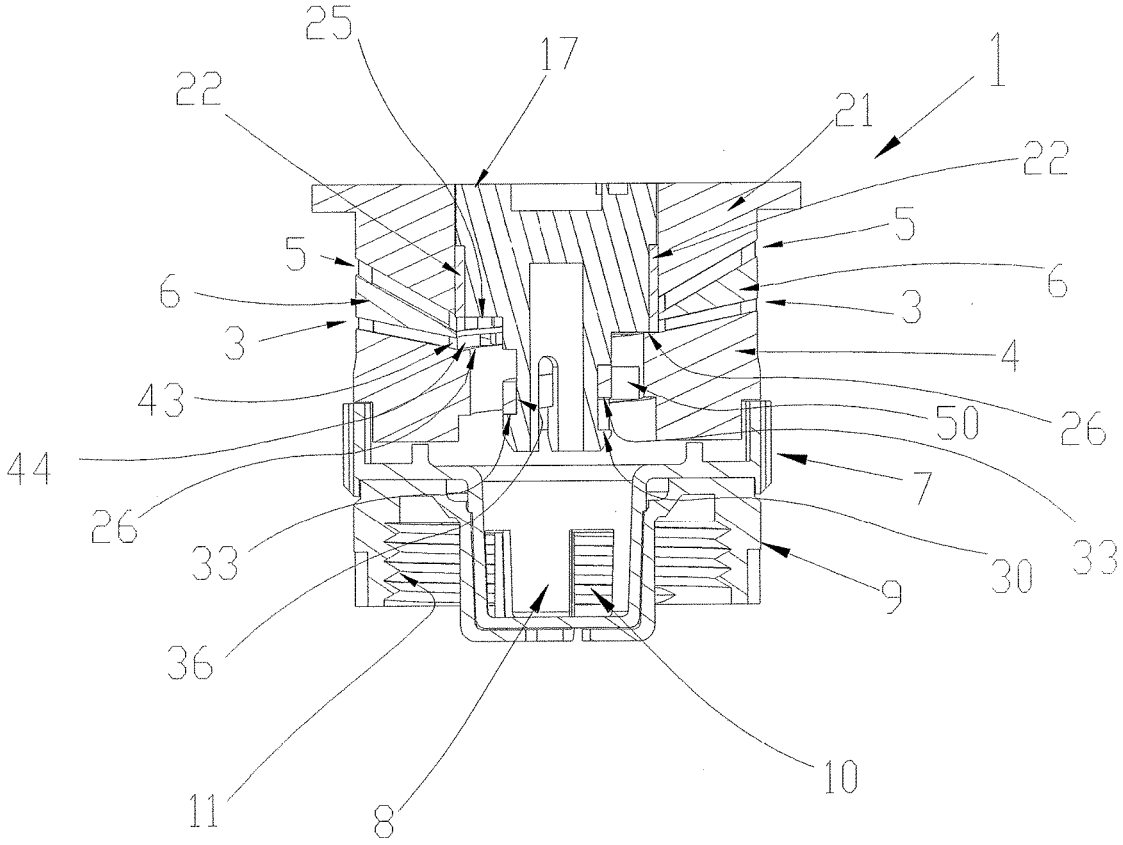
FIG. 2 shows a cross-section of the nozzle assembly of FIG. 1 with the multiple fluidic nozzles surrounding an adjustable arcuate opening valve and including an upstream nozzle range of coverage flow control valve operated by a circumferential ring around the outside of the nozzle housing.
Figure 6:
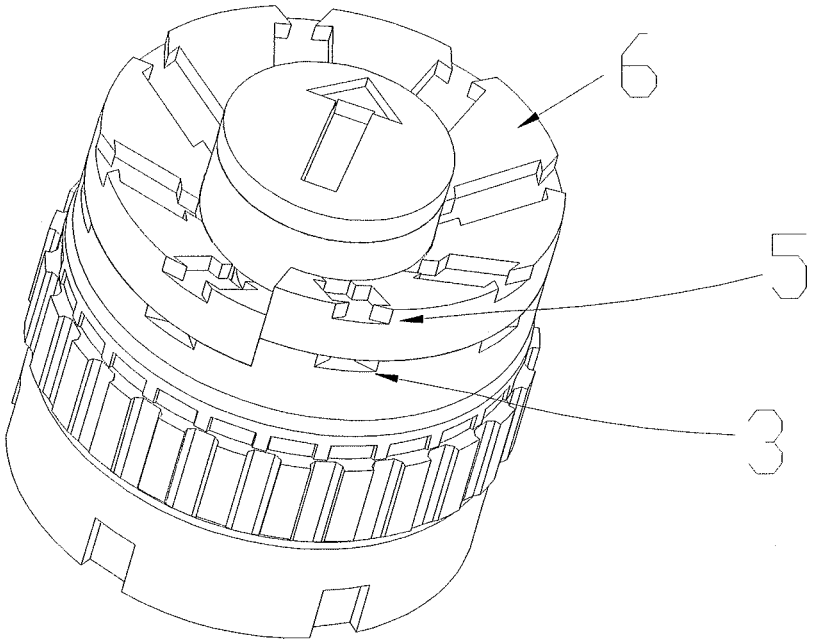
FIG. 6 shows a perspective view of the nozzle housing of FIG. 5 but with a second ring of fluidic nozzle cavities added around the center arc of coverage selection valve.
Figure 13:
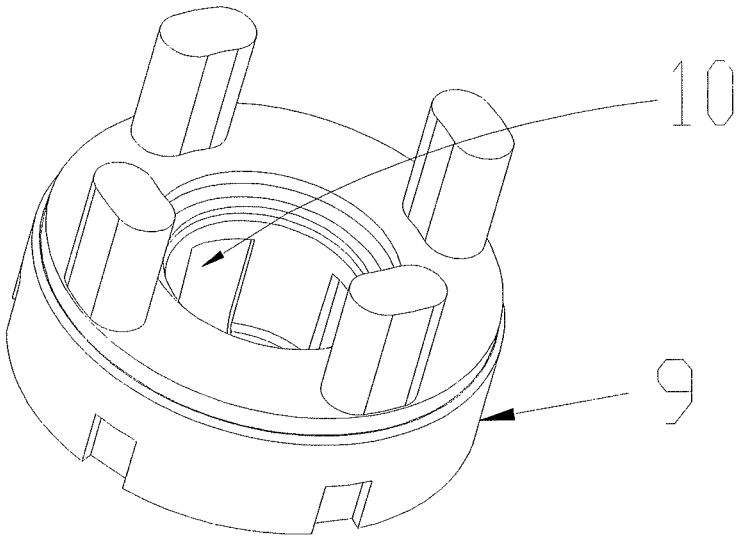
FIG. 13 shows a perspective view of the lower nozzle housing member only. The throttlable flow opening can be seen as well as the attachment parts for the upper nozzle housing members.

The nozzle assembly 1 includes a lower nozzle assembly housing piece 9, which has internal thread 11 (See FIG. 2) for attachment to a sprinkler riser and source of water at pressure. The lower housing 9 also includes the stationary water throttling parts 10, which can be seen in FIGS. 2 and 13, for example. As can be seen in FIG. 2, nozzle assembly 1 is preferably made up of a sonic welded stack-up of 4 housing members: (1) lower housing 9, (2) upper housing middle member 4, which has multiple fluidic nozzle cavities molded into its top surface as at 3 and further shown in FIG. 4, (3) upper housing upper member 6 which as shown in FIG. 6 and FIG. 2 provides the top closure for the lower ring of short range fluidic nozzle as at 3 and has the top ring of fluidic nozzle cavities as at 5 molded into it as seen in FIG. 6, and (4) the upper nozzle assembly housing member 21, which provides the top closure of fluidic nozzle cavities that are molded into the upper housing upper member 6 as shown at 5 and provides the higher stream elevation discharge angle for the upper fluidic cavities of, i.e., 27°. While the housing elements are illustrated and described above as separate elements, these elements may be integrated into a single housing element if desired. Alternatively, certain housing elements, such as the upper housing middle member, upper housing upper member and upper nozzle assembly housing member may be integrated into a single element.

Figure 12:
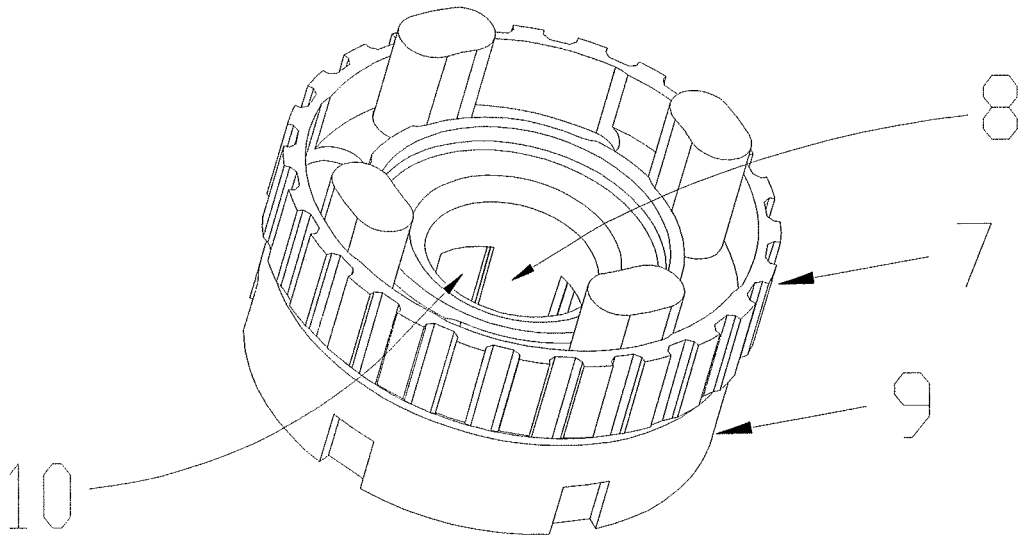
FIG. 12 shows a perspective view of the lower nozzle housing with circumferential ring flow control member in place as it would be before sonic welding attachment of the upper nozzle housing components.

The upstream rotatable throttling ring 7 as shown in FIG. 2 and FIG. 12 is preferably captured between the lower housing member 9 and the upper housing middle member 4 during the stack-up assembly of the adjustable arc of coverage with range flow control nozzle assembly 1 of FIG. 1.

Figure 3:
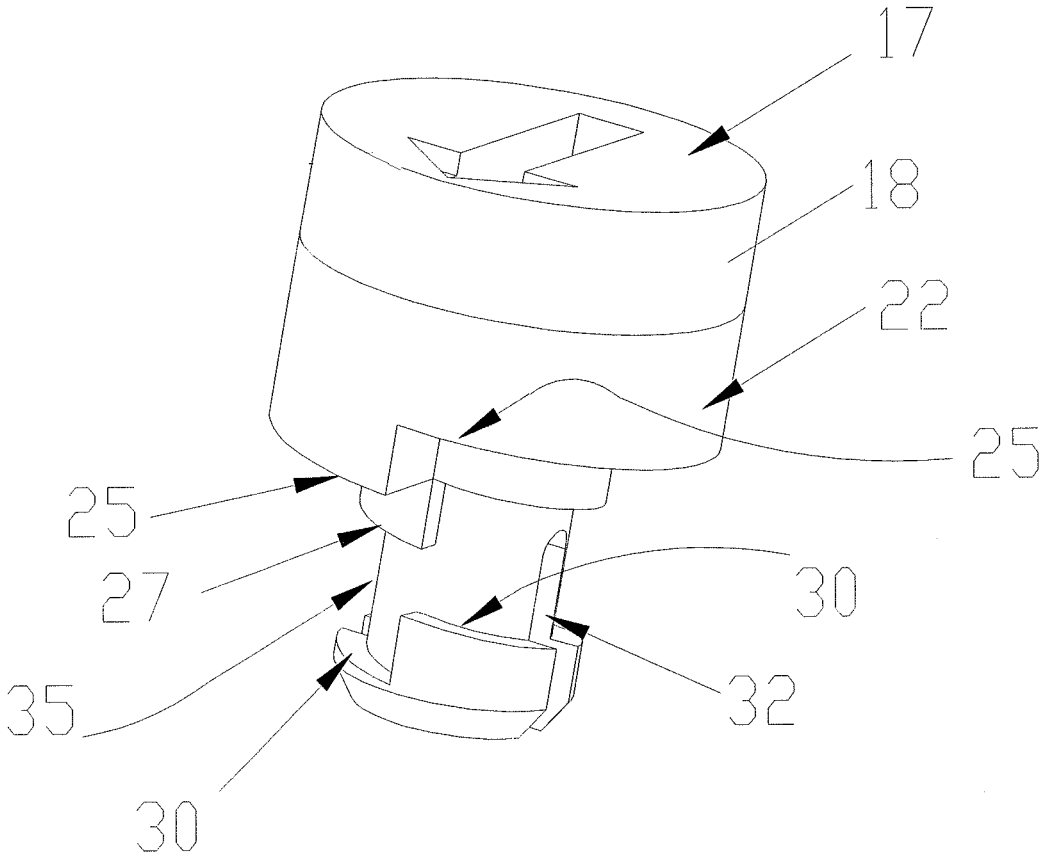
FIG. 3 shows a perspective view of the center rotationally settable arcuate valving member.
Figure 4:
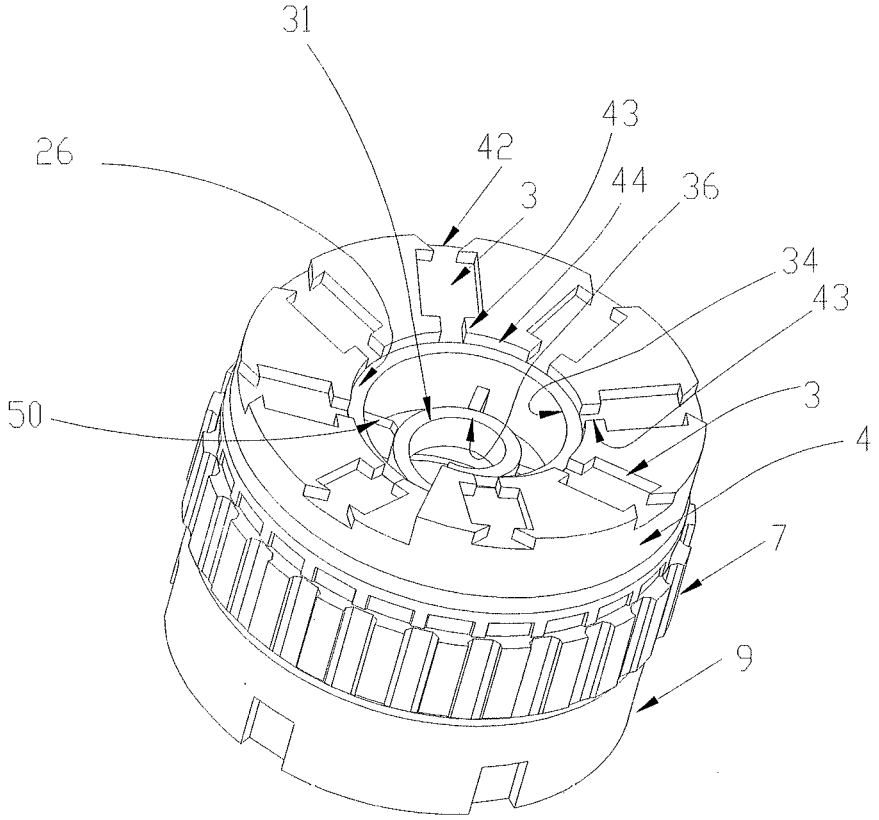
FIG. 4 shows a perspective view of the nozzle housing assembly with the top of the nozzle housing and center arcuate valving member as shown in FIG. 3 removed, with one circumferential arrangement of the multiple fluidic nozzles around the center located ARC of coverage selection valve can be seen.
Figure 5:
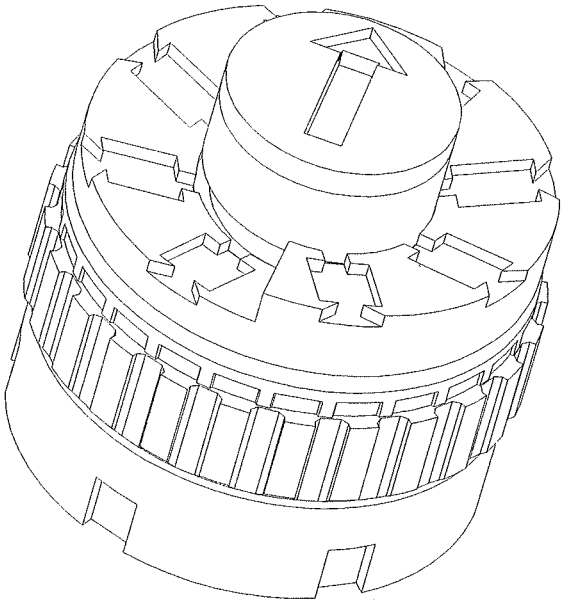
FIG. 5 shows a perspective view of the partial nozzle housing assembly of FIG. 4 with the center axially stepped arcuate valving member of FIG. 4 inserted into its operating position in the nozzle assembly housing.

The arc of coverage fluidic nozzle selection valve member 17 is shown in FIG. 3. It has a cylindrical upper body 18 with an axially stepped valving surface 25 around its under edge which cooperates with axially stepped arcuate valving surface 26 of the middle housing member 4 as shown in FIG. 4. In FIG. 2 the left side arcuate valving surface is shown open and the right side is still close against surface 26.

The arc of coverage selection valving member 17 cylindrical upper body lower outer circumferential surface has a co-molded elastomeric outer surface 22 also can be seen in FIG. 2 in cross section. This elastomeric flexible surface 22 is press sealed diametrically in the inner diameter hole in the middle of upper body 4 against the partition surfaces 44 between each of the fluidic cavities 3 and their orifice power nozzle throats 43 until the adjustable arc valving member 17 is rotated clockwise as shown and is moved upward by axially stepped spiral surface 31 as shown in FIG. 4 acting against surface 27 of valving member 17 as shown in FIGS. 2 and 4.

Also the valving member 17 is held in the middle upper housing by the snap stepped spiral surface 30 acting against the lower snap axially spiral surface 33 of the tubular center support hole 36. The tubular center support is retained in the middle upper body 4 by spaced ribs 50 as shown in FIGS. 2 and 4.

The interaction of axially stepped spiral surface 30 of the arc of coverage arcuate valving member 17 acting against the stationary axially stepped lower canning surface 33 of the upper middle nozzle housing member 4 center support tubular member 36 holds the arcuate valving member 17 arcuate open shut off axial stepped surface 25 against its notched pitch spiral step 26 of the upper middle housing member 4 as shown in FIGS. 2 and 4.

The arc adjustable valve member 17 is shown rotated to open the fluidic nozzle cavities 3 and 5 for coverage of 180° and the axially stepped spiraled valving surface 25 can be seen lifted as previously described during rotation to the setting for 180° of spray coverage by the fluidic nozzle cavities so that the orifice power nozzle throats 43 of the fluidic nozzle on the left side of cross section view of the nozzle assembly shown in FIG. 2 are open to water flow from the sprinkler riser which in operation would be attached by thread 11 to the adjustable fluidic nozzles spray head assembly 1. Flow enters the nozzle assembly through opening 10 of the upstream adjustable flow range control valve 7, also shown more detail FIG. 12.

The outside range adjustment up stream flow control ring 7 is connected to rotationally move downward protruding legs 8 over flow opening 10 to throttle the upstream flow into each of the four quadrants of 2 fluidic nozzle each which can be separately selected in increments of 45° increase of spray coverage in the nozzle assembly 1 as disclosed in FIG. 1.

Slot 32 in the lower shaft 35 of arc of coverage selection valve 17 allows the lower retention snap camming surface 30 to be pressed into the center hole 30 of the middle upper housing member 7 as seen in FIGS. 2, 3 and 4.

Figure 7:
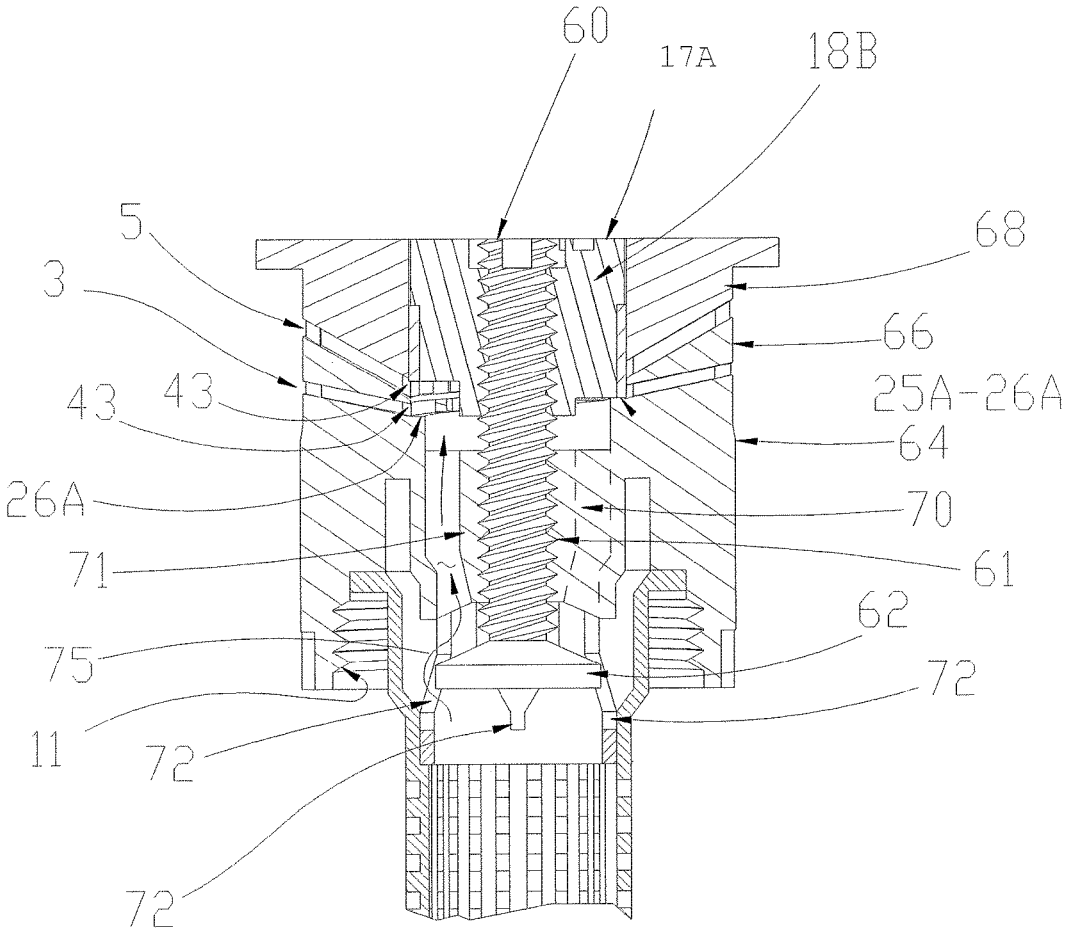
FIG. 7 shows a cross-sectional view of an alternate configuration of the arc of coverage selectable fluidic nozzles where the range flow control is provided by center screw whose up and down lead position determines the inlet flow area and the pitch of this screw thread also controls the axial movement of the arcuate center selection valving member.

FIG. 7 shows a cross sectional view of an alternate configuration where the arc settable valving member 17A is supported on a threaded center screw 60 which is also used to operate the upstream flow control valve. The thread pitch of the screw matches the axial stepped spiral arcuate valving surfaces so that arc setting valve member 17A is moved up and down and also supported in the nozzle housing by the threaded screw 60. In this configuration, since the upstream flow control valve is operated by the center screw 60, there does not need to be lower and middle nozzle house members 9 and 4 as in FIG. 1. The lower and middle nozzle housing is replaced with a single lower housing member 64 which has the lower series of fluidic cavities 3 molded into its top surface as previous for middle nozzle housing member 4 and the internal attachment thread 11 of the FIG. 2 lower nozzle housing member 9 in a single part as shown there are four support ribs 70 that support the center tubular area 71 through which the center threaded screw 60 threads interact to retain and move the screw up and down in this lower nozzle housing member 64.

The pitch of the 61 are the same as the arcuate valving member 17A lower axially stepped spiraled valving surface 25A so that as the arc set and valving member 17A is rotated together the valving member 17A is retained in contact with arcuate spiral valving surface 26A of nozzle housing member 64.

In FIG. 7 as in FIG. 2 the arc of coverage arcuate flow control valve 17A is shown in a position such that the fluidic cavity orifice 43 power nozzles are shown open to flow from the inside center flow area 75 from the upstream angle control flow throttling valve throttlable opening 72.

On the right side, the arcuate valve is shown closed to the nozzle orifice throats by the contact between surfaces 25A and 26A of the ARC of coverage arcuate valve member 17A and the matching nozzle housing arcuate valving surface 26A so these nozzles on the right side do not flow. The configuration has fewer parts and has the additional advantage that if the center screw 60 is tighter in the ARC of coverage valving member 17A than the threaded area in the housing tubular member 71 the screw will rotate with the ARC of coverage valving member 17A and the valving member and screw will rise up in the nozzle housing 68 such that the upstream head of the screw 62 will be raised as the axially stepped arcuate valve member is raised to flow to more of the fluidic nozzle inlet orifice 43 and the upstream range flow control area 72 can be shaped to maintain a proportional increasing rate so that once a design on inlet pressure has been selected or obtained in sprinkler operation once the arc of coverage flow control valve 17A rotational position is set relative flow control screw 60 then the range of coverage as adjusted at one position will be maintained throughout the various arc of coverage setting. This can be done at the manufacturing stage to provide uniform performance of selected range nozzles.

Figure 8:
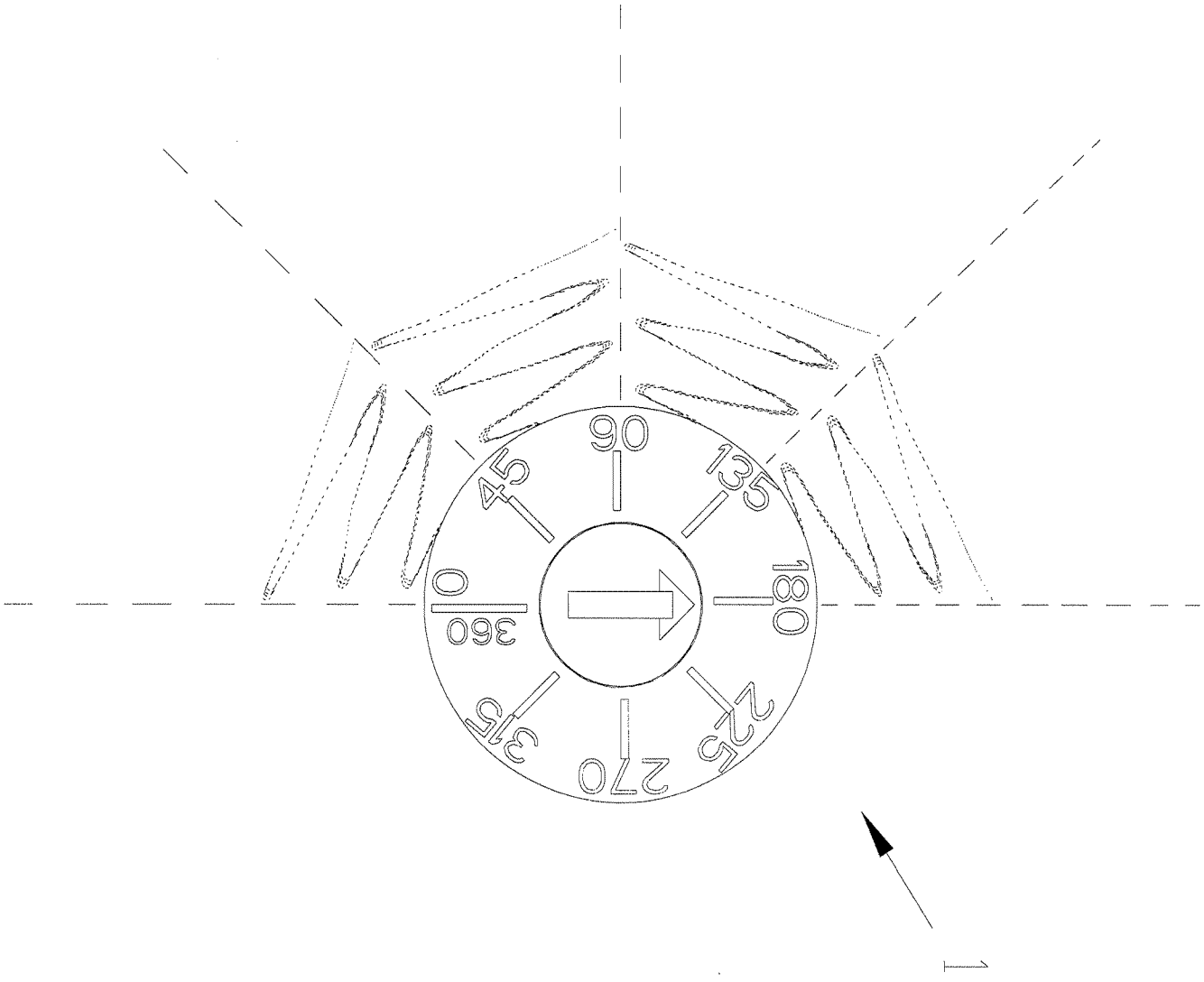
FIG. 8 shows a top pictorial view of the nozzle assembly depicting an arc setting for 180° of spray coverage around the sprinkler.

In FIG. 8 the oscillating fluidic nozzle streams are shown emitting around the settable arc of coverage nozzle assembly 1 for the coverage of 180° as set and indicated on the top of nozzle assembly 1.

Figure 9:
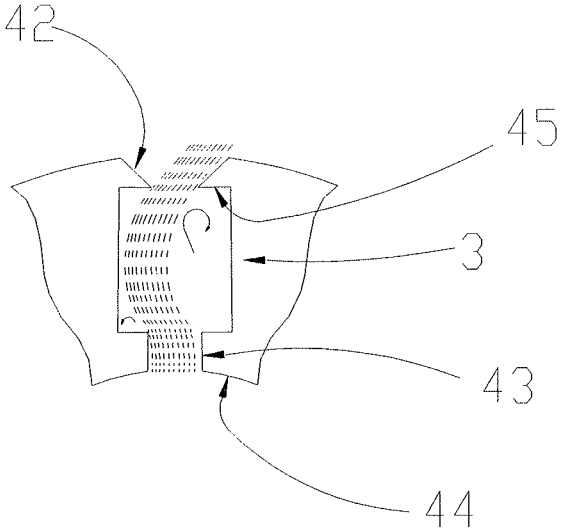
FIG. 9 is a diagrammatic illustration of a sequence vortex formation and the resulting displacement of the nozzle central flow stream of a simple fluidic nozzle cavity.

FIG. 9 shows a plan view of a typical small fluidic nozzle oscillator chamber 3 with the central stream from the orifice inlet power nozzle 43 being deflected to the left in the oscillation chamber of fluidic nozzle 3. The chambers 3, 5 are commonly referred to as fluidic nozzles or fluidic nozzle chambers. The chambers 3, 5 are configured such that a stream of water exiting the chamber oscillated back and forth to provide a fan-like coverage pattern. The oscillation chamber has a length which is greater than its width, with top and bottom walls, a pair of mutually facing side walls, an upstream wall and a downstream wall. The input orifice power nozzle 43 is formed in the upstream wall and has a width and depth and issues fluid into the oscillation chamber. The downstream end wall has an outlet formed therein, such that pressure within the chamber is always positive relative to the outside of the nozzle assembly ambient atmospheric pressure. Short walls of a desired oscillating exit streams exit maximum angle diverge from the exit cavity opening 45. Alternating pulsating vortices are formed in the chamber on each of the fluid streams flowing through the chamber alternately displacing this mainstream from side to side.

FIG. 9 shows displacement to the left hand side of the fluidic chamber resulting in a stream exit angle out chamber exit orifice 45 directed to the right as limited by the exit opening 45 divergent V walls at 42. The distance the stream travels is enhanced since it is an oscillating single stream with the resulting relatively high momentum of the entire flow from that nozzle orifice rather than small droplets as a result from a splash surface type of spray nozzle.

Figure 10:
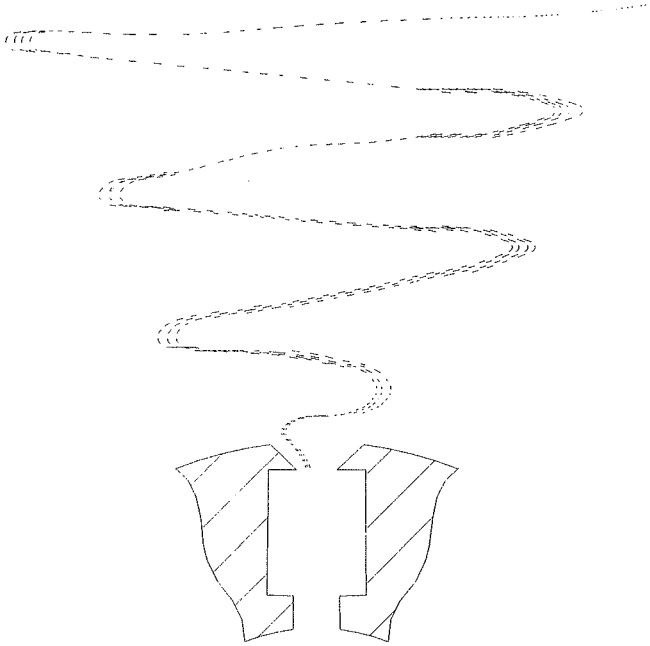
FIG. 10 is a diagrammatic illustration of spray pattern issuing during the fluidic oscillations produced during nozzle pressurized operation.

As this oscillating exit stream does progress through the outside air surrounding the sprinkler nozzle assembly 1, due to air drag and surface tension of the water in the stream, it does begin to break into droplets of varying sizes which provide a fan spray precipitation pattern around the sprinkler as depicted in FIG. 10.

Figure 11:
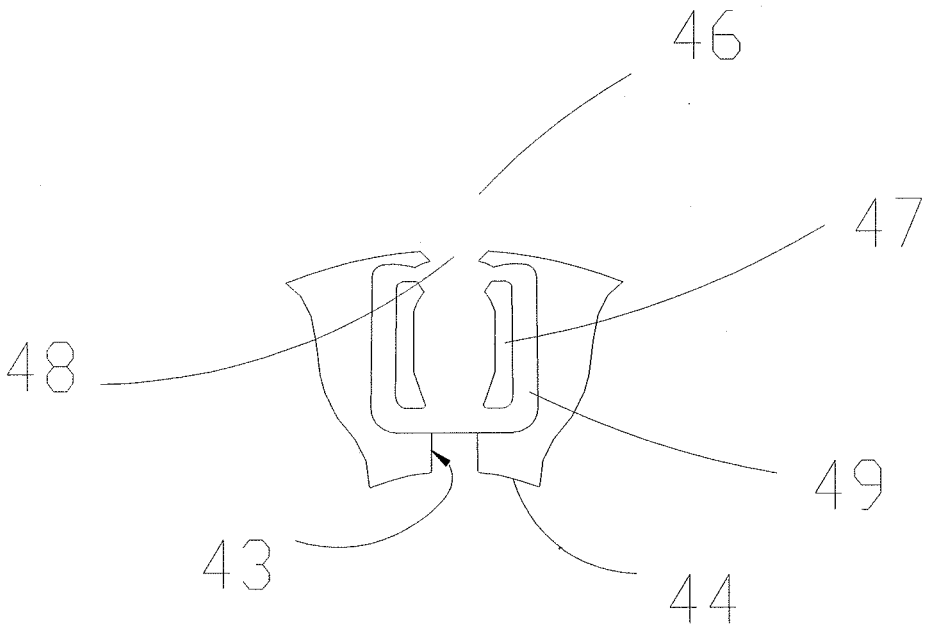
FIG. 11 is a diagrammatic illustration of a fluidic nozzle to which a pair of internal sidewalls have been added to provide feedback pressure channels to the exit of the center power inlet orifice. Manipulation of the component of the diagrammatic illustration may be used to establish spray fan angle and frequency of operation for drop size and distribution uniformity control.

FIG. 11 shows an exemplary diagrammatic illustration of the fluidic nozzle chamber 3 or 5 of adjustable arc of coverage nozzle assembly 1 where the fluidic oscillation chamber is widened to allow placing a pair of feedback passages 49 surrounding walls 47 to be placed on either side of the vortex oscillation chamber. Also a small deflection of break-up post which is shown dotted in the exit throat 46 as 48 may also be added. Manipulation of the components in the diagrammatic illustration may be used to establish spray fan angles and frequencies of operation for drop size and distribution uniformity control.

A fluidic spray nozzle chamber of this design produces selective uniform liquid droplets throughout their swept jet fan spray.

While the preferred embodiments of the invention have been illustrated and described modifications and adaptations has come within the spirit and scope of the application claims be covered.

Although the present invention has been described in relation to particular embodiments thereof, many other variations and modifications and other uses will become apparent to those skilled in the art.

What is claimed is:

1. A spray nozzle assembly comprising:

a housing element including an inlet configured to receive water from a supply, the housing element including a central bore defining a flow path for the water;

a plurality of fluidic oscillating nozzle chambers positioned circumferentially around the housing and configured to selectably distribute water from the spray nozzle assembly; and a valve member in the central bore of the housing and configured to selectably control flow of water through the flow path and to the plurality of nozzle chambers, such that only selected nozzle chambers distribute water.

2. The spray nozzle assembly of claim 1, wherein each nozzle chamber of the plurality of nozzle chambers is configured to provide an oscillating water stream exiting the spray nozzle assembly.

3. The spray nozzle assembly of claim 2, wherein each nozzle chamber of the plurality of nozzle chambers is configured such that a length of each nozzle chamber is larger than the width thereof.

4. The spray nozzle assembly of claim 3, wherein each nozzle chamber includes an inlet positioned adjacent to the central bore and configured to receive water from the flow path.

5. The spray nozzle assembly of claim 4, wherein an outlet of each nozzle chamber is positioned at a periphery of the housing.

6. The spray nozzle assembly of claim 1, wherein the plurality of nozzle chambers includes a first row of nozzle chambers having a first exit angle.

7. The spray nozzle assembly of claim 6, wherein the plurality of nozzle chambers includes a second row of nozzle chambers positioned above the first row of nozzle chambers having an exit angle greater than the first exit angle.

8. The spray nozzle assembly of claim 1, further comprising an upstream throttling element configured to adjust a flow of water through the flow path.

9. The spray nozzle assembly of claim 8, wherein the housing includes a lower housing member including the inlet, the lower housing member including at least one stationary throttling element.

10. The spray nozzle assembly of claim 9, wherein the upstream throttling member includes a throttling ring with at least one throttling flange movable into and out of alignment with the stationary throttling element to control the flow of water into the spray nozzle assembly.

11. The spray nozzle assembly of claim 9, wherein the upstream throttling member includes a screw element passing through the valve element which may be rotated to control the flow of water into the spray nozzle assembly.

12. The spray nozzle assembly of claim 1, wherein the valve element is positioned in the central bore to control the flow of water through the central bore to the plurality of nozzle chambers.

13. The spray nozzle assembly of claim 1, wherein a top portion of the valve element is cylindrical in shape and the bottom portion includes a stepped spiral valving surface, the valve element rotatable in the spray nozzle assembly to control an arc of coverage of the spray nozzle assembly.

14. The spray nozzle assembly of claim 1, wherein the housing further comprises indicia provided on a top surface thereof indicating the arc of coverage set by the valving element.

15. The spray nozzle assembly of claim 1, wherein the arc of coverage is adjustable form 0 degrees and 360 degrees.

16. The spray nozzle assembly of claim 15, wherein the spray nozzle assembly is shut off when the arc of coverage is set at 0 degrees.

17. The spray nozzle of claim 1, further comprising an elastomeric seal provided around a top portion of the valve member and configured to prevent water leakage out of a top of the housing.

18. An adjustable arc of coverage spray nozzle assembly for irrigation comprising:

a circular plate including multiple fluidic oscillating stream nozzle cavities molded therein; and an adjustable arcuate length orifice valve configured so that one or more of the fluidic oscillating stream nozzle cavities is selected to be provided with pressurized water to provide a selectable arc of coverage, the pressurized water providing water jets from the orifice valve that are cyclically deflected at a high frequency in the stream nozzle cavities to break up into fan shaped water droplet patterns in which fluid distribution and droplet size is controlled, the deflection is provided based on the energy in the water jets.

19. The adjustable arc of coverage spray nozzle assembly of claim 18, wherein each nozzle cavity of the multiple nozzle cavities is configured to provide an oscillating water stream exiting the spray nozzle assembly.

20. The adjustable arc of coverage spray nozzle assembly of claim 19, wherein each nozzle cavity of the multiple nozzle cavities is configured such that a length of each nozzle cavity is larger than the width thereof.

* * * * *